US006840583B1

(12) United States Patent
Turner et al.

(10) Patent No.: US 6,840,583 B1
(45) Date of Patent: Jan. 11, 2005

(54) CHAIR WITH RETRACTABLE STEP STOOL

(75) Inventors: Dennis M. Turner, Mooresville, IN (US); Paul T. Zink, Indianapolis, IN (US); Andrew B. Mendenhall, Indianapolis, IN (US); Joseph D. Baumgartner, Carmel, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/745,726

(22) Filed: Dec. 24, 2003

(51) Int. Cl.[7] ..... A47C 20/00; A47C 7/50; A47C 16/02; A47C 9/00; A47C 15/00

(52) U.S. Cl. ..... 297/423.19; 297/423.2; 297/423.21; 297/423.4; 297/423.41; 297/175; 297/236

(58) Field of Search ..... 297/423.19, 423.2, 297/423.21, 423.25, 423.39, 423.4, 423.41, 423.44, 175, 236

(56) References Cited

U.S. PATENT DOCUMENTS

| | | | | | |
|---|---|---|---|---|---|
| 21,536 | A | * | 9/1858 | Holmes | 297/423.21 X |
| 38,718 | A | * | 5/1863 | Watson et al. | 297/423.2 |
| 88,921 | A | * | 4/1869 | Snow | 297/175 X |
| 183,924 | A | * | 10/1876 | Harrison | 297/423.21 X |
| 268,517 | A | * | 12/1882 | Miller | 297/423.19 |
| 283,111 | A | * | 8/1883 | Isberg | 297/423.19 |
| 406,313 | A | * | 7/1889 | Smith | 297/423.21 X |
| 547,517 | A | * | 10/1895 | Gardner et al. | 297/423.19 |
| 595,450 | A | * | 12/1897 | Archer | 297/423.19 |
| 791,593 | A | * | 6/1905 | Tanck | 297/175 |
| 967,452 | A | * | 8/1910 | Silverman | 297/423.21 X |
| 975,188 | A | * | 11/1910 | Williams | 297/423.2 |
| 986,401 | A | * | 3/1911 | Michalsky | 297/175 |
| 1,079,606 | A | * | 11/1913 | Rooney | 297/423.4 X |
| 1,277,886 | A | * | 9/1918 | Elliman | 297/423.2 |
| 1,333,867 | A | * | 3/1920 | Manzari | 297/423.19 X |
| 1,402,698 | A | * | 1/1922 | Weingarten | 297/423.2 |
| 1,984,281 | A | * | 12/1934 | Poggendorf | 297/423.2 X |
| 2,177,174 | A | * | 10/1939 | Eccles | 297/423.4 X |
| 2,247,720 | A | * | 7/1941 | Wonderly | 297/423.2 X |
| 2,326,910 | A | * | 8/1943 | Young | 297/423.21 X |
| 2,495,374 | A | * | 1/1950 | Horn | 297/423.21 X |
| 2,658,225 | A | * | 11/1953 | Bascom | 297/423.21 X |
| 2,900,011 | A | * | 8/1959 | Casey | 297/411.28 |
| 3,031,230 | A | * | 4/1962 | Roe et al. | 297/423.21 X |
| 4,165,124 | A | * | 8/1979 | Olan | 312/423.21 X |
| 4,455,050 | A | * | 6/1984 | Kubek | 297/423.2 |
| 4,564,238 | A | * | 1/1986 | Wolpert, Jr. | 297/423.19 X |
| 4,848,842 | A | * | 7/1989 | Stringham | 297/423.2 |
| 5,094,505 | A | * | 3/1992 | Nichols | 297/423.41 X |
| 5,277,477 | A | * | 1/1994 | Sharff et al. | 297/423.21 |
| 5,312,161 | A | * | 5/1994 | Mars | 297/423.2 |
| 5,380,059 | A | * | 1/1995 | Felling | 297/423.21 X |
| 5,489,140 | A | * | 2/1996 | Van Horn-Plato | 297/423.21 X |
| 6,648,418 | B2 | * | 11/2003 | Bergeron et al. | 297/423.21 X |

* cited by examiner

*Primary Examiner*—Rodney B. White
(74) *Attorney, Agent, or Firm*—Barnes & Thornburg LLP

(57) ABSTRACT

A chair and step stool assembly includes a seat, a seat back, and a plurality of legs coupled to the seat. The seat and step stool further include a retractable step stool that is coupled to the chair frame and, when activated, allows the step stool to move to a storage position nested within the plurality of legs under the seat.

13 Claims, 2 Drawing Sheets

CHAIR WITH RETRACTABLE STEP STOOL

BACKGROUND

The present disclosure relates to chairs, and particularly to a chair associated with a step stool. More particularly, the present disclosure relates to a step stool mounted for movement relative to a chair.

Step stools have a step that people use for elevation when reaching for objects, painting walls, washing windows, or any everyday task where additional elevation is helpful. It is desired to associate a step stool with a chair to provide a multi-function apparatus for use in the home or elsewhere.

SUMMARY

In accordance with the present disclosure, a chair assembly includes a seat, a step stool, and means for connecting the step stool to the chair for movement to a first position under the seat, and a second position in front of the seat.

In illustrative embodiments, the chair includes a seat, a back, and a plurality of legs. The step stool includes a plurality of steps coupled to a step stool frame having a plurality of legs. Each step includes a step surface and a side wall coupled to a perimeter of the step surface.

The connecting means includes a guide track situated below the seat at one or both sides of the chair or step stool. Each guide track defines a channel for guided movement of an associated pin. Illustratively, the guide track may be mounted on the chair and the pin mounted on the step stool. The guide pin travels within the length of the channel when a user moves the step stool from the first position under the seat to the second position in front of the seat. The guide track is formed to have an arcuate shape bowed upwardly toward the seat. Since the pin is coupled to the step stool, it travels the length of the channel in an arcuate path when moved by a user. Thus, the step stool is elevated such that typically the rear legs of the step stool avoid contact with the floor when moved from the first position to the second position.

Retention means is provided so that the step stool is retained in either the first or second position when so moved by a user. The retention means may illustratively be a retainer situated at each end of the floor of the guide track. The retainer is formed to receive the pin coupled to the step stool for keeping the step stool in either the first or second position when moved there by a user.

A series of horizontal brackets coupled to the chair legs form a band around an outside perimeter of the legs of the chair. When the step stool is in the first position situated under the seat, the front legs of the step stool are arranged so that they remain outside of the band formed by the horizontal brackets. When a user moves the step stool to the second position in front of the seat, the rear legs of the step stool remain inside the band formed by the horizontal brackets and abut or confront a horizontal bracket coupled to a lower portion of a left and right front leg of the chair. The front horizontal bracket acts to prevent rotational movement of the step stool about an axis formed by the pin.

Additional features of the disclosure will become apparent to those skilled in the art upon consideration of the following detailed description of preferred embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
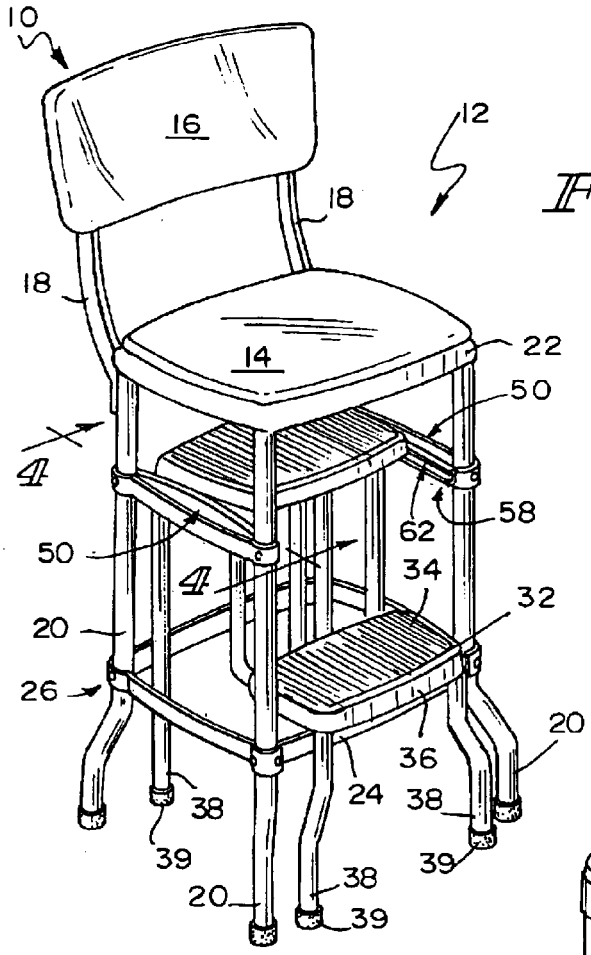
FIG. 1 is a perspective view of a chair assembly including a retractable step stool assembly having a plurality of upwardly facing step surfaces supported in a generally horizontal position by a step frame and nested underneath the seat.
Figure 2:
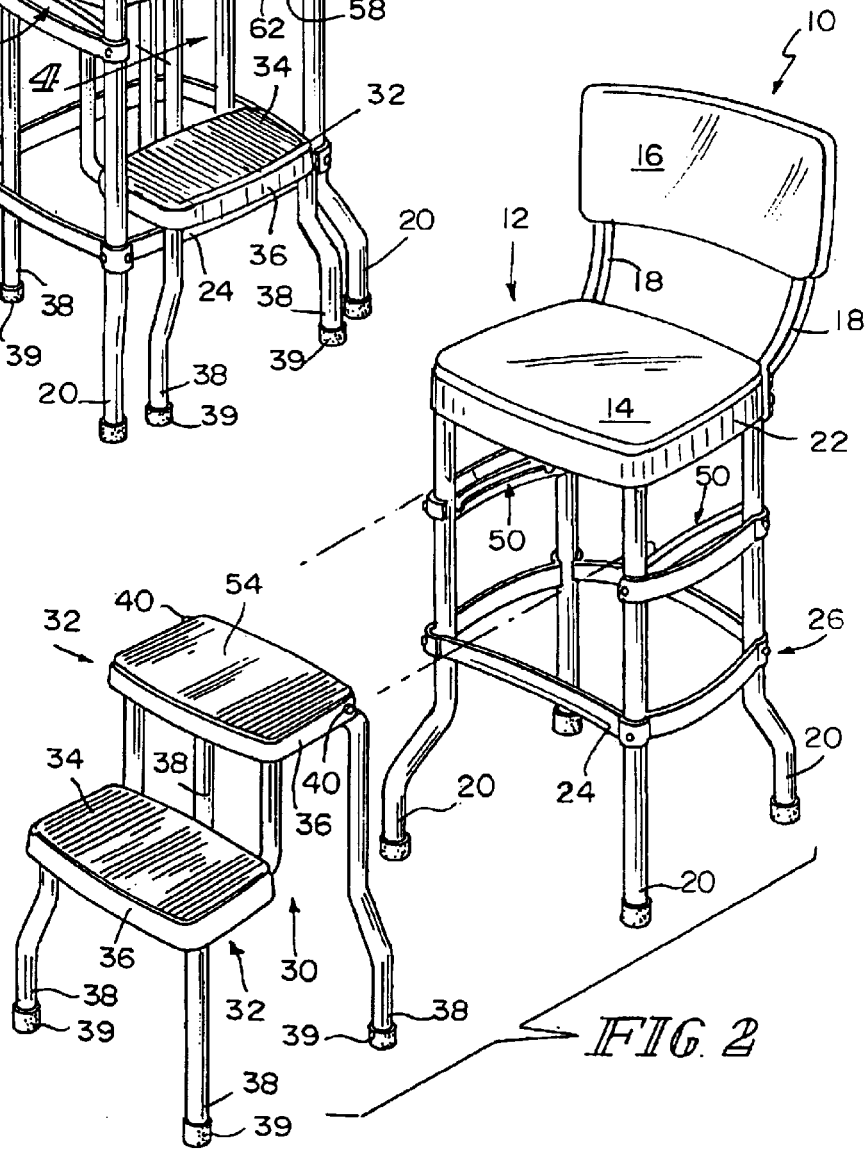
FIG. 2 is an exploded perspective view of the step stool assembly of FIG. 1 with the step stool assembly moved in front of the seat.
Figure 3:
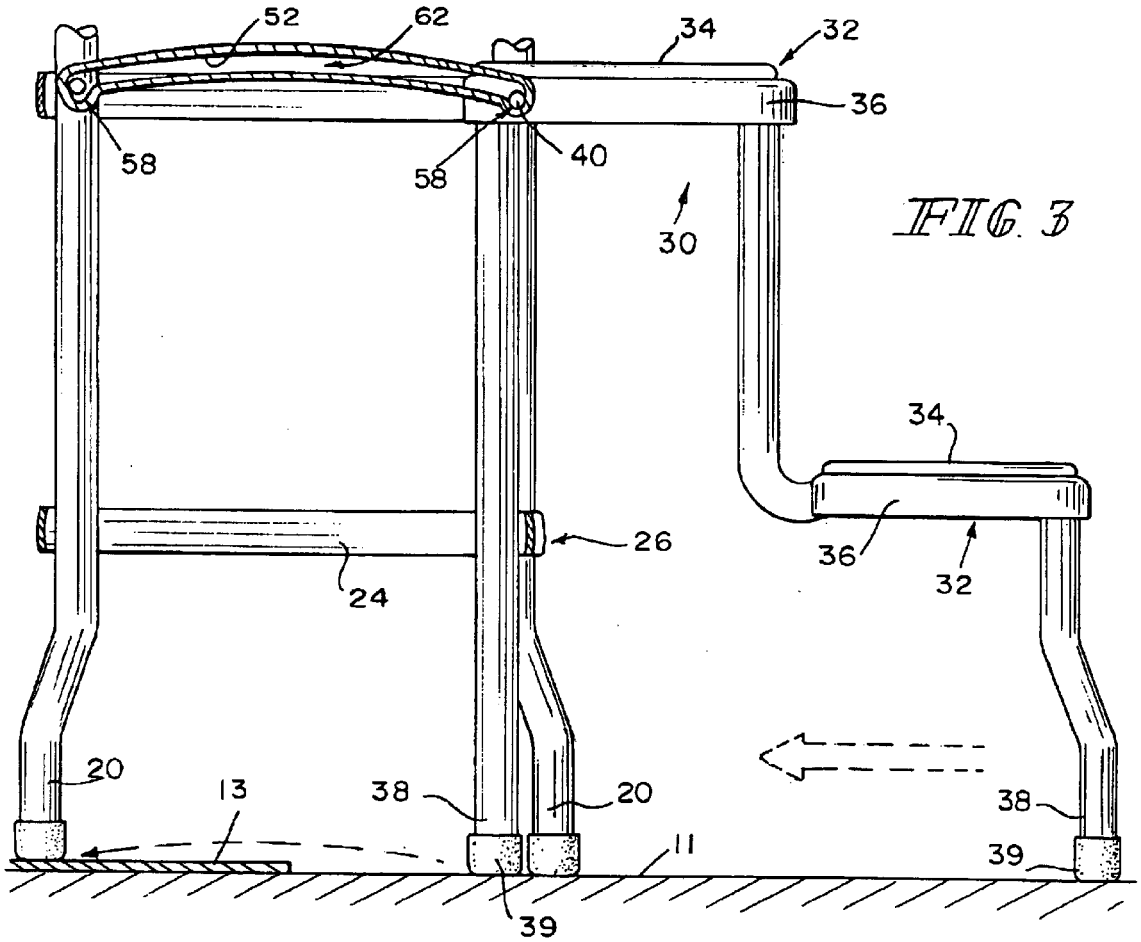
FIG. 3 is a partially sectional side elevation view of the step stool assembly, taken along line 4—4 of FIG. 1, coupled to a guide track, and a motion arrow in phantom indicating the movement required to return the step stool assembly to the position nested underneath the seat.

A chair assembly 10 in accordance with this disclosure comprises a chair 12, a step stool 30, a guide track 50 at each side of chair 12, and a pin 40 at each side of step stool 30 as shown in FIGS. 1–3. Chair 12 comprises a seat 14, a seat back 16, seat back supports 18, and a plurality of legs 20. Each leg 20 is coupled to a bottom surface of seat 14. Seat 14 is formed having a side wall 22 coupled at an upper edge 22 to a perimeter of seat 14. Seat back supports 18 are coupled to legs 20 and to seat back 16 as shown best in FIG. 1.

As shown in FIGS. 1 and 2, step stool 30 comprises a plurality of steps 32. Each step 32 has a step surface 34 and a side wall 36 coupled at an upper edge of side wall 36 to a perimeter edge of step surface 34. Step stool 30 further comprises a plurality of legs 38 coupled at their upper ends to the bottom surface of steps 32.

Figure 4:
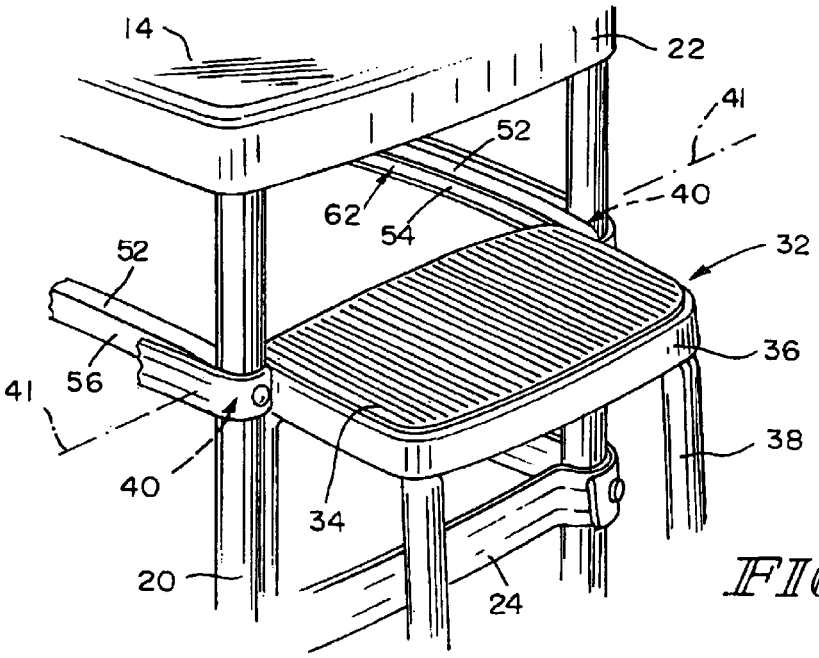
FIG. 4 is a fragmentary perspective view of the stool with portions broken away, with the step stool assembly moved to a position in front of the seat.

Referring now to FIGS. 3 and 4, each guide track 50 is configured with a ceiling 52, a floor 54, and a side wall 56. Ceiling 52 and floor 54 cooperate to define a pin-receiving channel 62 therebetween. Each guide track 50 is situated below seat 14 and coupled to an upper portion of front leg 20 at a front end and coupled to an upper portion of rear leg 20 at a rear end.

Ceiling 52 is generally formed in a registered relationship with floor 54, with channel 62, therebetween, providing means for receiving associated guide pin 40. Each pin 40 is coupled to side wall 36 generally in alignment with and adjacent to a rear leg 38 of the top step 32. It is within the scope of this disclosure that, alternatively, each guide pin 40 may be coupled to inside facing surfaces of each front leg 20 of chair 12 and each guide track 50 may be coupled to the side of top step 32.

Referring now to FIG. 3, the illustrative ceiling 52 and floor 54 are arcuate in shape and bowed upwardly toward seat 14. The arcuate shape of guide track 50 and pin-receiving channel 62 provides means for guiding step stool 30 from the first position under chair 12 to the second position in front of chair 12 and back without feet 39 of rear legs 38 snagging on, for example, carpeting 13 or other flooring surfaces. Typically, when a user moves stool 30 to the first or second position, they will grasp a front portion of a lower step 32 of stool 30 and slightly rotate the stool in a counter-clockwise direction along an axis 41. This slight rotation causes front legs 38 of stool 30 to lift off of flooring surface 11 for forward or rearward movement of stool 30. As pin 40 moves along channel 62 in an arcuate path, feet 39 of rear legs 38 elevate slightly to avoid contact with flooring 11. This action allows stool 30 to move in a smooth motion as feet 39 avoid snagging on carpeting or other flooring materials.

Referring now to FIGS. 1 and 2, a series of horizontal brackets 24 coupled to the chair legs form a band 26 around an outside perimeter of the legs 20 of chair 12. When step stool 30 is in the first position situated under seat 14 as suggested in FIG. 1, front legs 38 of step stool 30 are arranged so that they remain outside of the perimeter formed by horizontal brackets 24. When a user moves step stool 30 to the second position in front of chair 12 as suggested in FIG. 2, rear legs 38 of step stool 30 remain inside band 26 formed by horizontal brackets 24 and abut or confront horizontal bracket 24 coupled between a lower portion of a left and right front leg 20. Front horizontal bracket 24 acts to prevent rotational movement of step stool 30 along axis 41 formed by pins 40.

As shown best in FIG. 3, guide track floor 54 further comprises a retainer 58 situated at each end of floor 54. Each retainer 58 is configured to define an upwardly facing, concave-shaped hollow on floor 54. Each retainer 58 acts to provide means for retaining pin 40 in a pre-determined position associated with a user moving step stool 30 to the first position under chair 12 or the second position in front of chair 12.

Seat and step stool 10, according to the present disclosure, may be fabricated from a variety of materials which may be formed into the desired configurations. For example, in some embodiments of seat and step stool 10, chair 12 and step stool 30 are each made of one-piece plastic construction. In such embodiments, pin 40 may be formed monolithically with or otherwise attached to the top of the steps 32. Likewise, guide track 50 may be formed monolithically with chair 12. Suitable plastic materials include thermoplastics, high-density polyethylene, polyvinyl chloride, polypropylene, acrylics, and the like. Seat 14, back 16, and step 32 may be made from a material that is the same as or different from the material from which other portions of the associated apparatus are made. Portions of legs 20 and 38, pin 40, and guide track 50 may be made from metal, composite materials, fiber glass, fiber board, cardboard, paper board, or any other type of material having suitable strength and/or desirable aesthetic characteristics. Different portions of seat and step stool 10 may be made from different materials. For example, step 32 may be made from plastic materials while leg 38 is fabricated from metal.

What is claimed is:

1. A chair and step stool comprising a seat, a step stool, the step stool having a pair of front legs and a pair of rear legs extending downwardly from the step stool, each of the legs having feet for resting on and supporting the step stool on a support surface, and a guide unit comprising a guide track, to which the stool is coupled for movement, the guide unit configured to retain the stool in a fixed position relative to the chair upon movement of the stool between a first position under the seat, and a second position in front of the chair, the guide track allowing forward and rearward movement of the step stool from the first position to the second position and back to the first position, wherein the guide track has a shape that, when a front portion of the step stool is lifted and then pulled forward for movement from the first position to the second position or pushed rearward for movement from the second position to the first position, the rear feet of the step stool are elevated to avoid contact with the support surface during the forward or rearward movement.

2. The chair and step stool of claim 1, wherein the chair includes a seat, providing a sitting surface.

3. The chair and step stool of claim 1, wherein the step stool includes a frame having a plurality of steps and a guide pin, the guide pin movable in the guide track.

4. A chair and step stool comprising a seat, a step stool, and a guide unit comprising a guide track, to which the stool is coupled for movement, the guide unit configured to retain the stool in a fixed position relative to the chair upon movement of the stool between a first position under the seat, and a second position in front of the chair, wherein the guide track is arcuate in shape and the guide track is bowed upwardly toward the seat.

5. The chair and step stool of claim 4, wherein the guide track has a floor which is bowed upwardly toward the seat.

6. The chair and step stool of claim 4, wherein a guide pin is coupled to the step stool and wherein the guide track includes a retainer for the pin formed at each end of the guide track.

7. The chair and step stool of claim 6, wherein each guide pin retainer forms a concave surface facing upwardly toward the seat.

8. The chair and step stool of claim 3, wherein the guide pin is coupled to the step stool adjacent to a rear leg of the step stool.

9. The chair and step stool of claim 1, wherein the chair comprises front legs and a bracket extending therebetween.

10. A chair and step stool comprising a seat, a step stool, and a guide unit comprising a guide track having a ceiling floor, side wall, a pin-receiving channel and a pin coupled to the step stool and arranged to move in the channel as the step stool moves between a position under the seat and a position in front of the seat, wherein the guide track is arcuately shaped, with the apex situated toward the seat.

11. The chair and step stool of claim 1, wherein the chair has legs and the step stool is situated within the legs of the chair in the first position.

12. The chair and step stool of claim 11, wherein the chair further comprises front and rear legs and a bracket positioned between the front legs.

13. The chair and step stool of claim 1, wherein the guide pin is coupled to the step stool and is situated generally in alignment with and adjacent to a rear leg of the step stool.

* * * * *